US010338519B2

(12) United States Patent
Uohashi

(10) Patent No.: US 10,338,519 B2
(45) Date of Patent: Jul. 2, 2019

(54) IMAGE FORMING APPARATUS

(71) Applicant: KYOCERA Document Solutions Inc., Osaka (JP)

(72) Inventor: Yuki Uohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/142,174

(22) Filed: Sep. 26, 2018

(65) Prior Publication Data

US 2019/0129355 A1 May 2, 2019

(30) Foreign Application Priority Data

Oct. 30, 2017 (JP) ..... 2017-209667

(51) Int. Cl.
*G03G 21/16* (2006.01)

(52) U.S. Cl.
CPC ..... *G03G 21/1695* (2013.01); *G03G 21/1647* (2013.01)

(58) Field of Classification Search
CPC ..... G03G 21/1695; G03G 21/1647
See application file for complete search history.

(56) References Cited

U.S. PATENT DOCUMENTS

2017/0277102 A1* 9/2017 Takai ..... G03G 21/1647
2018/0067448 A1* 3/2018 Tahara ..... G03G 21/1633

FOREIGN PATENT DOCUMENTS

JP 2004-240329 A 8/2004

* cited by examiner

*Primary Examiner* — Susan S Lee
(74) *Attorney, Agent, or Firm* — Studebaker & Brackett PC

(57) ABSTRACT

An image forming apparatus includes a conveying unit, a boss, a hook member and an auxiliary pressing member. The conveying unit is provided at an apparatus main body in a turnable manner and configured to form or open a nip area. The boss is provided at the apparatus main body. The hook member is provided at the conveying unit in a turnable manner and configured to be engaged with the boss when the conveying unit is turned to a position where the nip area is formed. The auxiliary pressing member is configured to press the hook member in a direction in which the hook member is engaged with the boss after the hook member is engaged with the boss. A direction in which the auxiliary pressing member presses the hook member is different from a turning direction of the conveying unit.

7 Claims, 13 Drawing Sheets

IMAGE FORMING APPARATUS

INCORPORATION BY REFERENCE

This application is based on and claims the benefit of priority from Japanese Patent application No. 2017-209667 filed on Oct. 30, 2017, which is incorporated by reference in its entirety.

BACKGROUND

The present disclosure relates to an image forming apparatus provided with a conveying unit configured to form or open a conveying path.

An image forming apparatus, such as a copying machine and a printer, is generally configured to include an apparatus main body and a conveying unit provided at the apparatus main body in a turnable manner in an upper-and-lower direction. Between the apparatus main body and the conveying unit, a conveying path for a sheet is formed. When the conveying unit is turned upward, a hook provided at the conveying unit is engaged with a boss provided at the apparatus main body. Additionally, one resist roller and a secondary transferring roller provided at the conveying unit respectively come into contact with the other resist roller and an intermediate transferring belt provided at the apparatus main body to form the conveying path. On the other hand, when the conveying unit is turned downward, the hook is disengaged with the boss to open the conveying path.

In the image forming apparatus having such a configuration, just before the hook of the conveying unit is engaged with the boss of the apparatus main body, reaction force generated on the one resist roller and the secondary transferring roller pressed by the other resist roller and the intermediate transferring belt becomes large. This requires large force in order to engage the hook with the boss. For example, in a case where the hook is engaged with the boss by a spring, the spring requires large spring force.

However, if the force for engagement of the hook with the boss is made large simply, large force is required to disengage the hook with the boss and workability is deteriorated. Then, in some cases, the hook is secondarily pushed by an outer cover provided outside the conveying unit to engage the hook with the boss. In this case, because a direction in which the outer cover pushes the hook is the same as a turning direction of the conveying unit, a nip pressure between the one resist roller and the other resist roller and a nip pressure between the secondary transferring roller and the intermediate transferring belt are affected to cause sheet conveying failure or the like.

SUMMARY

In accordance with an aspect of the present disclosure, an image forming apparatus includes a conveying unit, a boss, a hook member and an auxiliary pressing member. The conveying unit is provided at an apparatus main body in a turnable manner and configured to form or open a nip area between the conveying unit and the apparatus main body. A sheet is conveyed through the nip area. The boss is provided at the apparatus main body. The hook member is provided at the conveying unit in a turnable manner and configured to be engaged with the boss when the conveying unit is turned to a position where the nip area is formed. The auxiliary pressing member is configured to press the hook member in a direction in which the hook member is engaged with the boss after the hook member is engaged with the boss. A direction in which the auxiliary pressing member presses the hook member is different from a turning direction of the conveying unit.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an embodiment of the present disclosure will be described.

Figure 1:
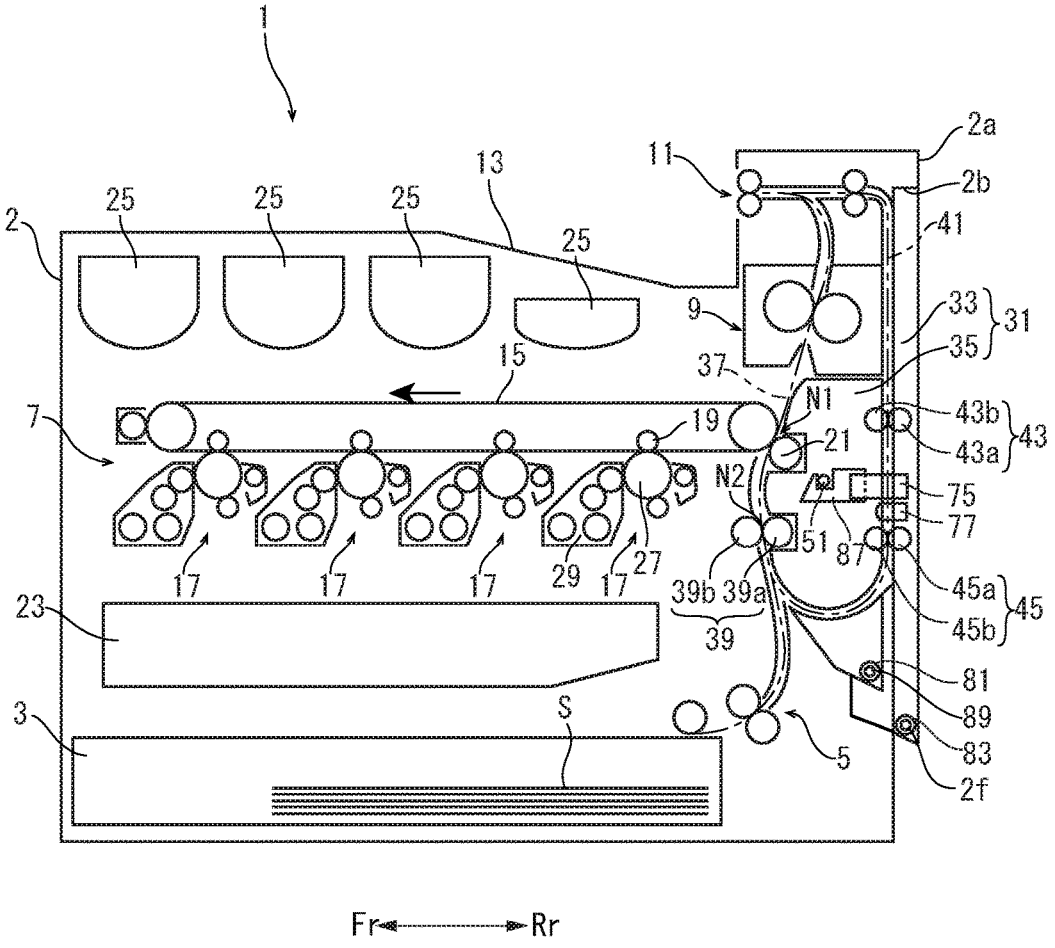
FIG. 1 is a front view schematically showing an inner structure of a color printer according to one embodiment of the present disclosure.

With reference to FIG. 1, an entire structure of a color printer 1 as the image forming apparatus will be described. FIG. 1 is a front view schematically showing the inner structure of the color printer 1. Herein after, a left side of a paper surface is defined to be a front side of the color printer 1. "Fr", "Rr", "L" and "R" in each figure respectively indicates "a front side", "a rear side", "a left side" and "a right side" of the color printer 1.

An apparatus main body 2 of the color printer 1 is provided with a sheet feeding cassette 3 storing a sheet S, a sheet feeding device 5 feeding the sheet S from the sheet feeding cassette 3, an image forming part 7 forming a toner image on the sheet S, a fixing device 9 fixing the toner image on the sheet S, a sheet ejecting device ejecting the sheet S and an ejected sheet tray 13 on which the ejected sheet S is stacked.

The image forming part 7 includes an intermediate transferring belt 15, four image forming units 17, four primary transferring rollers 19, a secondary transferring roller 21, an exposure device 23 and four toner containers 25. The intermediate transferring belt 15 is circulated and carries a full color toner image. The four image forming units 17 form toner images using toners (developers) of four colors (yellow, magenta, cyan and black). The four primary transferring rollers 19 transfer the formed toner images to the intermediate transferring belt 15. The secondary transferring roller 21 transfers the full color toner image transferred to the intermediate transferring belt 15 to the sheet S. The exposure device 23 exposes each image forming unit 17 based on an image data. The four toner containers 25 store the toners of the four colors. Each image forming unit 17 includes a photosensitive drum 27 which is exposed by the exposure device 23 to form an electrostatic latent image and a development device 29 which develops the electrostatic latent image to the toner image.

A rear side plate 2*a* of the apparatus main body 2 is formed with an opening 2*b*. The opening 2*b* is opened and closed by a cover unit 31 which is turnable around its lower end. The cover unit 31 includes an outer cover 33 and a conveying unit 35. The conveying unit 35 is supported on an inner face of the outer cover 33 (a surface at the side of the apparatus main body 2) in a turnable manner.

Between the conveying unit 35 and the apparatus main body 2, a conveying path 37 for the sheet S is formed. The conveying path 37 is formed from the sheet feeding device 5 to the sheet ejecting device 11 through the image forming part 7 and the fixing device 9. On the conveying path 37, a resist rollers pair 39 is provided at the downstream side of the sheet feeding device 5 in the conveying direction. The secondary transferring roller 21 and one resist roller 39*a* of the resist rollers pair 39 are supported by the conveying unit 35 in a rotatable manner. The other resist roller 39*b* of the resist rollers pair 39 is supported by the apparatus main body 2 in a rotatable manner.

When the conveying unit 35 is turned upward with respect to the apparatus main body 2, the conveying path 37 is formed between the conveying unit 35 and the apparatus main body 2. Then, the secondary transferring roller 21 comes into contact with the intermediate transferring belt 15 with a suitable pressure to form a transfer nip N, as a nip area, between them. Additionally, the one resist roller 39*a* comes into contact with the other resist roller 39*b* with a suitable pressure to forma resist nip N2, as a nip area, between them. On the other hand, when the conveying unit 35 is turned downward with respect to the apparatus main body 2, the conveying path 37, the transfer nip N1 and the resist nip N2 are opened. This makes it possible to remove the sheet S jammed on the conveying path 37.

Between the outer cover 33 and the conveying unit 35, an inversion path 41 for duplex printing is formed. The inversion path 41 extends downward from the sheet ejecting device 11 and joins the conveying path 37 between the sheet feeding device 5 and the resist rollers pair 39. On the inversion path 41, two conveying rollers pairs 43 and 45 are provided at a predetermined interval in the conveying direction. One conveying rollers 43*a* an 45*a* of the conveying rollers pairs 43 and 45 are supported by the outer cover 33 in a rotatable manner and the other conveying rollers 43*b* and 45*b* of the conveying rollers pairs 43 and 45 are supported by the apparatus main body 2 in a rotatable manner.

When the outer cover 33 is turned upward with respect to the conveying unit 35, the inversion path 41 is formed between the outer cover 33 and the conveying unit 35. Then, the one conveying rollers 43*a* and 45*a* of the conveying rollers pairs 43 and 45 come into contact with the other conveying rollers 43*b* and 45*b* with a suitable pressure. On the other hand, when the outer cover 33 is turned downward with respect to the conveying unit 35, the inversion path 41 is opened. This makes it possible to remove the sheet S jammed on the conveying path 41.

Next, an image forming operation will be described. In each image forming unit 17 of the image forming part 7, the exposure device 23 forms an electrostatic latent image on the photosensitive drum 27 based on an image data. The development device 29 develops the electrostatic latent image to a toner image. The toner images formed by the image forming units 17 are primarily transferred on the intermediate transferring belt 15 by the primary transferring rollers 19 to form a full color toner image on the intermediate transferring belt 15.

On the other hand, the sheet S is fed by the sheet feeding device 5 from the sheet feeding cassette 3 and conveyed by the resist rollers pair 39 at the same timing as the above described toner image forming operation. Then, at the transferring nip N1, the full color toner image on the intermediate transferring belt 15 is secondarily transferred on the sheet S by the secondary transferring roller 21. The sheet S on which the toner image is secondarily transferred is conveyed along the conveying path 37 to the fixing device 9. The fixing device 9 fixes the toner image on the sheet S. The sheet S on which the toner image is fixed is ejected by the sheet ejecting device 11 on the ejected sheet tray 13. When duplex printing is performed, the sheet in which the toner image is fixed on one face is inverted at the sheet ejecting device 11, conveyed along the inversion path 41 and the conveying path 37 again, and then an image is formed on the other face of the sheet in the same manner as the one face of the sheet.

Figure 2:
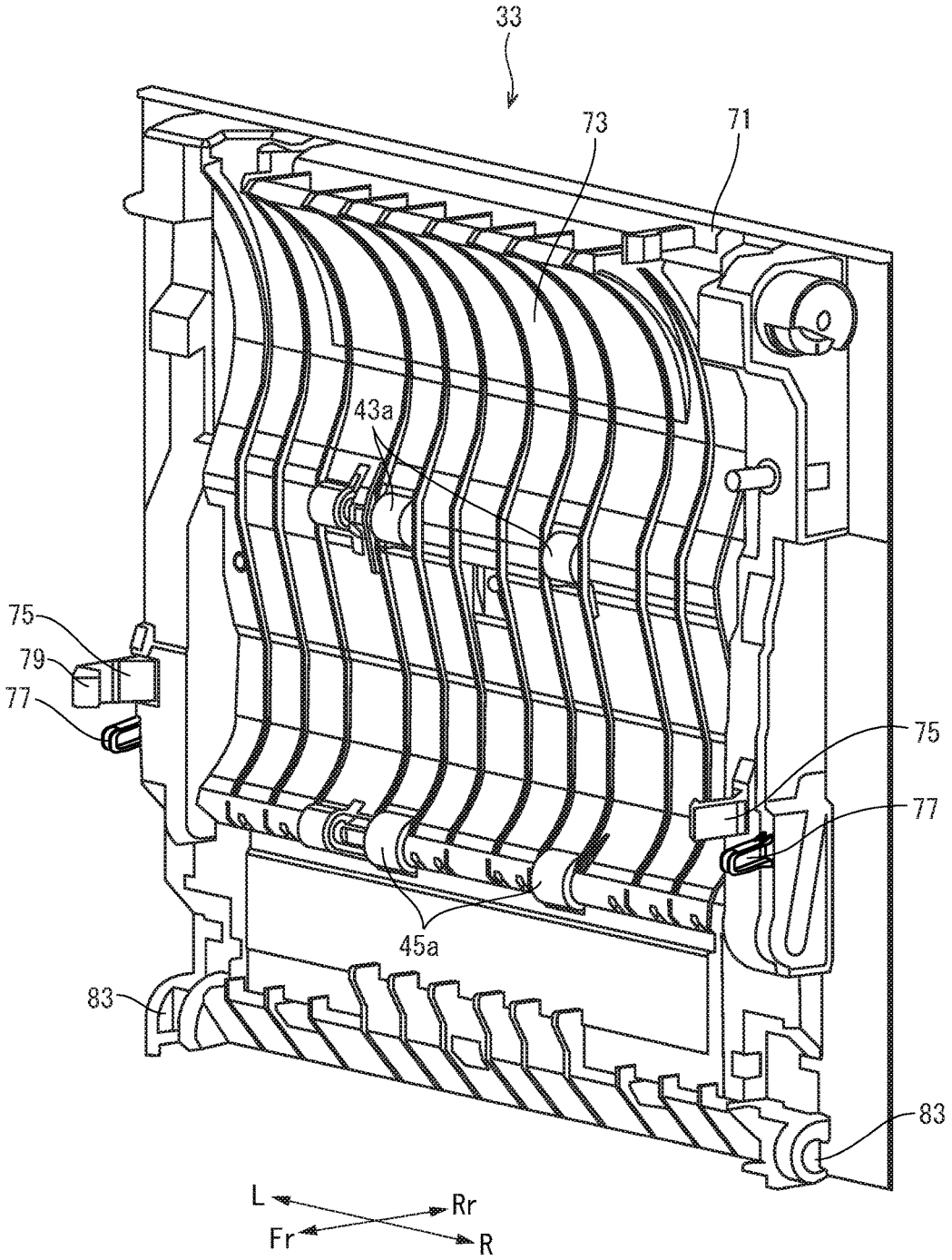
FIG. 2 is a perspective view showing an outer cover of the color printer according to the embodiment of the present disclosure.
Figure 3:
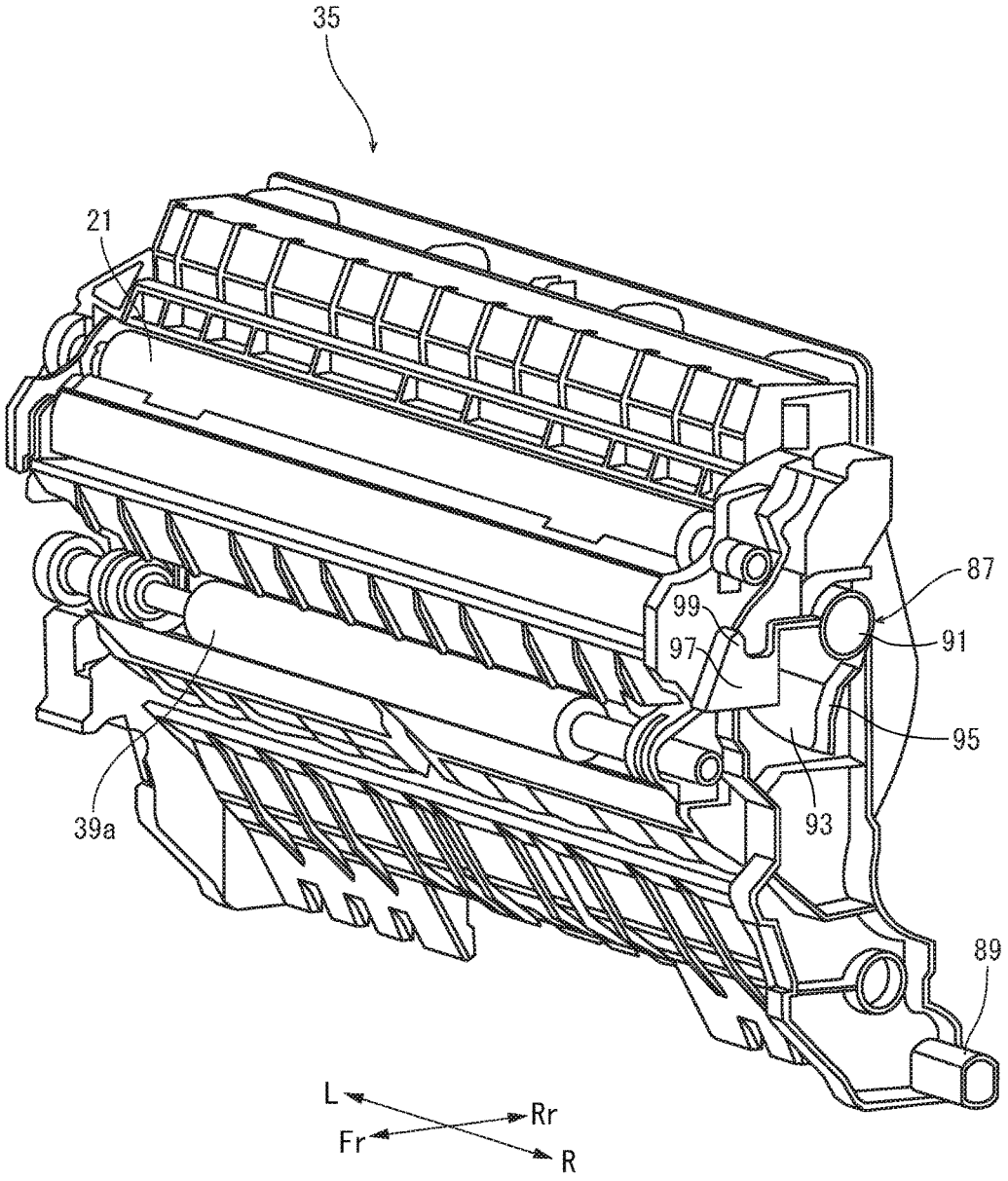
FIG. 3 is a perspective view showing a conveying unit of the color printer according to the embodiment of the present disclosure.

Next, with reference to FIG. 2 and FIG. 3, the outer cover 33 and the conveying unit 35 of the cover unit 31 will be described. FIG. 2 is a perspective view showing the outer cover and FIG. 4 is a perspective view showing the conveying unit.

The outer cover 33 and the conveying unit 35 are coupled to each other. The outer cover 33 and the conveying unit 35 are respectively engaged with engagement parts provided at the apparatus main body 2 when turned upward with respect to the apparatus main body 2.

Figure 4A:
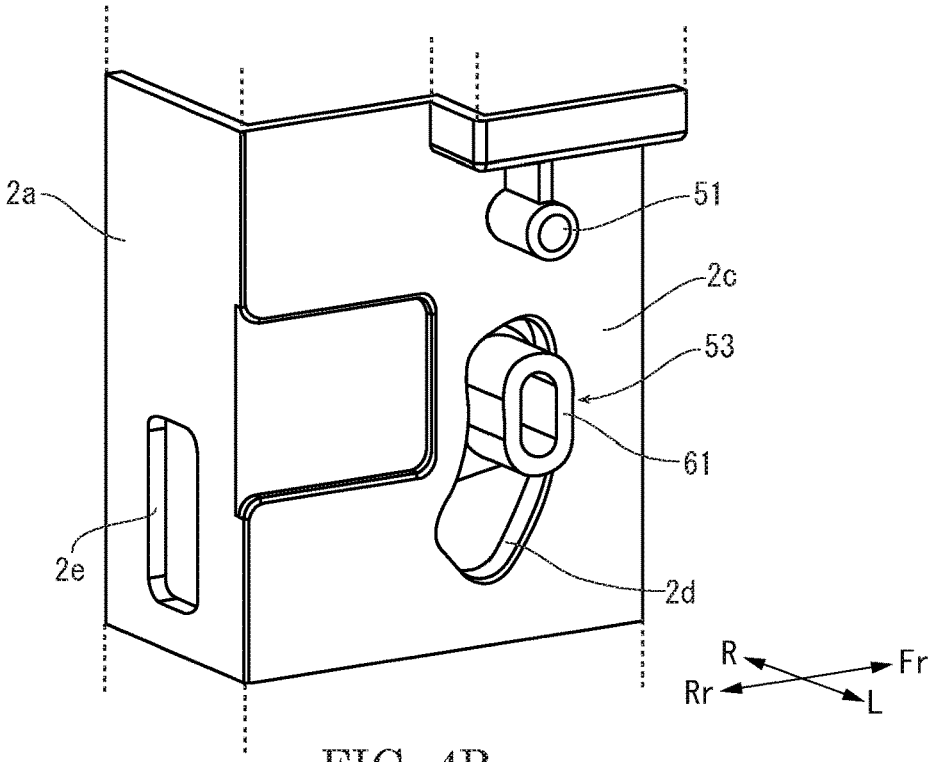
FIG. 4A is a perspective view showing a right side boss and a right side auxiliary pressing member, when viewed from a rear left side, in the color printer according to the embodiment of the present disclosure.
Figure 4B:
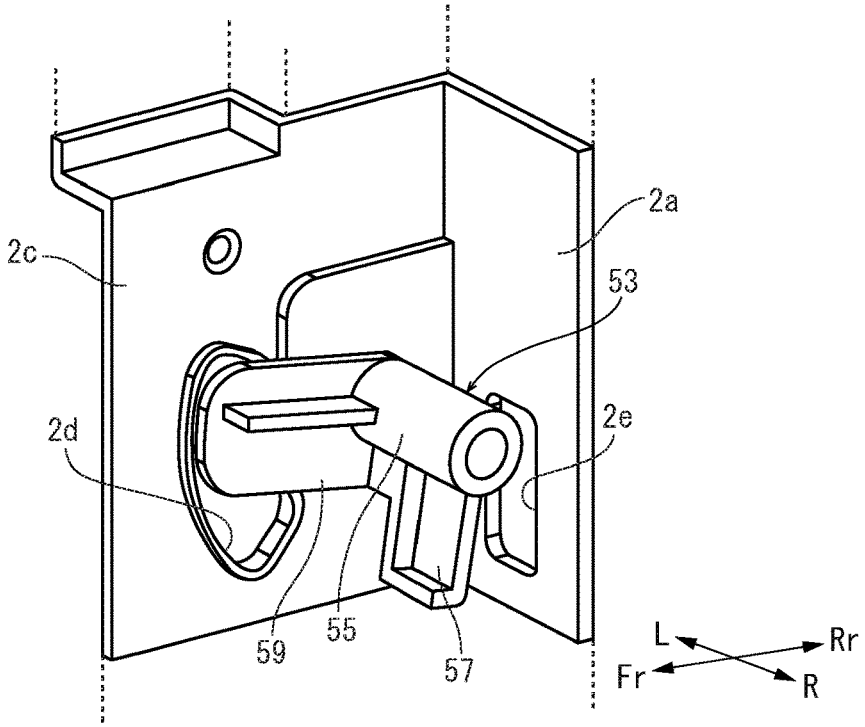
FIG. 4B is a perspective view showing the right side boss and the right side auxiliary pressing member, when viewed from a front right side, in the color printer according to the embodiment of the present disclosure.

First, the engagement part with the conveying unit 35 will be described with reference to FIG. 4A and FIG. 4B. FIG. 4A is a perspective view showing the right side engagement part when viewed from the left rear side and FIG. 4B is a perspective view showing the right side engagement part when viewed from the right front side. A description regarding the engagement part with the outer cover 33 is omitted.

The rear side plate 2*a* of the apparatus main body 2 includes a pair of inner plates 2*c* facing each other in the left-and-right direction. The pair of inner plates 2*c* are bent forward from both side edges of the opening 2*b*. On an inner face (a face at a side of the opening 2*b*) in the left-and-right direction of each inner plate 2*c*, a boss 51 is protruded from the substantially center portion in the upper-and-lower direction. The bosses 51 of the both inner faces are opposed to each other. On an outer face (a face at an opposite side to the opening 2*b*) in the left-and-right direction of each inner plate 2*c*, an auxiliary pressing member 53 is supported in a turnable manner. The auxiliary pressing member 53 is configured to engage the conveying unit 35 with the apparatus main body 2 firmly.

As shown in FIG. 4B, the auxiliary pressing member 53 includes a cylindrical turning shaft 55, a first arm 57 and a second arm 59 each protruding from the turning shaft 55 in a radial direction. The first arm 57 is formed in a rectangular shape when viewed from a direction perpendicular to an axial direction of the turning shaft 55, and protruded in a radial direction from an outer circumferential face of the turning shaft 55. The second arm 59 is formed in a substantially rectangular shape when viewed from the axial direction of the turning shaft 55, and protruded in a radial direction from one end in the axial direction of the outer circumferential face of the turning shaft 55. The first arm 57 and the second arm 59 are crossed each other almost at right angles around the turning shaft 55. The first arm 57 is shorter than the second arm 59. As shown in FIG. 4A, on a tip portion of one face (a face at the one end in the axial direction of the turning shaft 5) of the second arm 59, a cylindrical pressing part 61 is protruded in parallel with the axial direction of the turning shaft 55.

The turning shaft 55 is supported in a rotatable manner at the rear side of and below the boss 51. The second arm 59 is protruded forward from the turning shaft 55. The pressing part 61 is passed through an opening 2*d* of the inner plate 2*c* and faces the boss 51 from the lower side. The opening 2*d* is formed in an arc shape around the turning shaft 55. The first arm 57 is protruded downward from the turning shaft 55. The auxiliary pressing member 53 is supported by a torsion coil spring (not shown) such that the second arm 59 is turned downward around the turning shaft 55. The auxiliary pressing member 53 is capable of being turned against biasing force of the torsion coil spring until the pressing part 61 is engaged with an upper edge of the opening 2*d*. On the rear side plate 2*a* of the apparatus main body 2, a vertically-long rectangular opening 2*e* is formed so as to face the first arm 57 of the auxiliary pressing member 53.

Next, with reference to FIG. 2, the outer cover 33 will be described. The outer cover 33 includes a substantially rectangular shaped cover plate 71 and a guide part 73. The cover plate 71 forms a part of the rear side plate 2*a* of the apparatus main body 2. The guide part 73 is formed on an inner face of the cover plate 71. On a front face (a face at a side of the apparatus main body 2) of the guide part 73, one guide face of the inversion path 41 is formed. On the guide face, one roller 43*a* and 45*a* of the conveying rollers pairs 43 and 45 are supported in a rotatable manner. On each side face in the left-and-right direction of the guide part 73, a hook part 75 and a push part 77 are protruded forward from the substantially center portion in the upper-and-lower direction.

Figure 5:
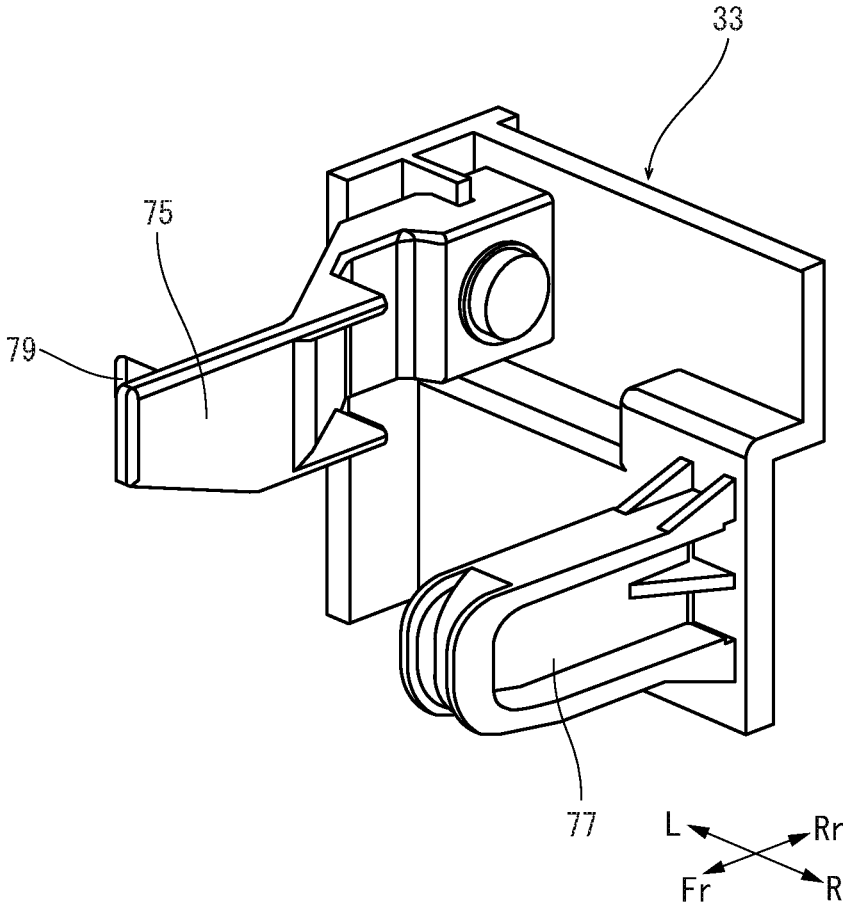
FIG. 5 is a perspective view showing a hook part and a push part of the outer cover, in the color printer according to the embodiment of the present disclosure.

With reference to FIG. 5, the hook part 75 and the push part 77 will be described. FIG. 5 is a perspective view showing the right side hook part and the push part.

The hook part 75 is formed in a horizontally-long substantially rectangular shape when viewed from the right side of the apparatus main body 2. The hook part 75 is deformable in the left-and-right direction (toward a side of the opening 2*b* and toward an opposite side to the opening 2*b*). At a tip end portion of the hook part 75, a claw 79 is protruded inward in the left-and-right direction (toward the side of the opening 2*b*). The push part 77 is formed in a horizontally-long substantially rectangular shape when viewed from the right side of the apparatus main body 2. A tip end portion of the push part 77 is curved in an arc shape. The push part 77 is positioned below the hook part 75 and at an outside (at the opposite side to the opening 2*b*) of the hook part 75. The hook part 75 is longer than the push part 77, and protruded more forward than the push part 77.

With reference to FIG. 2 again, on a lower portion of each side face of the guide part 73, a lower axial hole 83 is formed. Into the lower axial holes 83, supporting shafts 2*f* (refer to FIG. 1) provided at the apparatus main body 2 are inserted. Thereby, the outer cover 33 is supported in a turnable manner upward and downward around the supporting shafts 2*f*.

Next, with reference to FIG. 3, the conveying unit 35 will be described. The conveying unit 35 includes a front face plate, a rear face plate and left and right side plates. The front face plate forms the other guide face of the conveying path 37. The rear face plate forms the other guide face of the inversion path 37.

The front face plate is curved protruding forward. On a portion slightly lower than an apex portion of the front face plate, the one resist roller 39*a* of the resist rollers pair 39 is supported in a rotatable manner. On a portion slightly higher than the apex portion of the front face plate, the secondary transferring roller 21 is supported in a rotatable manner. On the rear face plate, the other rollers 43*b* and 45*b* of the conveying roller pairs 43 and 45 are supported in a rotatable manner.

On an upper portion of each side plate, a hook member 87 capable of being engaged with the boss 51 of the apparatus main body 2 is supported. On a lower portion of each side plate, a turning shaft 89 is formed. The turning shafts 89 are inserted in upper axial holes 81 provided at the apparatus main body 2. Thereby, the conveying unit 35 is turned upward and downward along a circumferential direction around the turning shafts 89. The upper axial holes 81 are arranged above the supporting shafts 2*f* (refer to FIG. 1).

Figure 6:
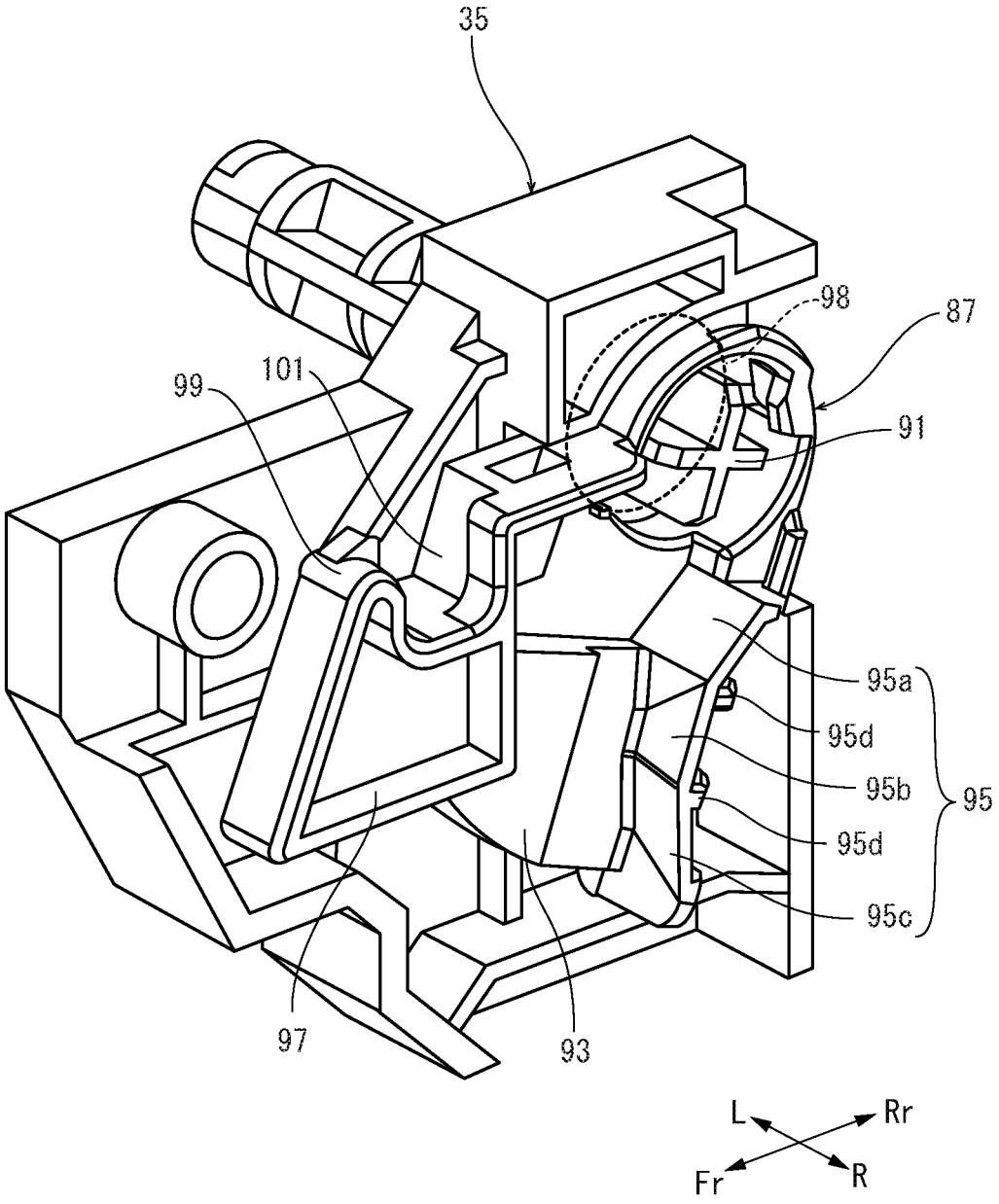
FIG. 6 is a perspective view showing a hook member of the conveying unit, in the color printer according to the embodiment of the present disclosure.

With reference to FIG. 6, the hook member 87 will be described. FIG. 6 is a perspective view showing the right side hook member.

The hook member 87 includes a shaft part 91 and a main part 93 provided at one end portion of the shaft part 91. The main part 93 has a substantially fan shape around the shaft part 91. The main part 93 includes an engagement part 95 and a hook part 97.

The engagement part 95 is formed on an outer face of the main part 93 in the left-and-right direction. The engagement part 95 is formed along one side edge (a rear side edge, a side edge at the side of the outer cover 33) of the main part 93. The engagement part 95 includes a base side inclined piece 95*a*, a central piece 95*b* and a tip side inclined piece 95*c* in the order from the shaft part 91. The base side inclined piece 95*a* is inclined toward an inside of the main part 93 from the shaft part 91. The central piece 95*b* extends parallel to the rear side edge from a tip end of the base side inclined piece 95*a*. The tip side inclined piece 95*c* is inclined toward a tip end of the rear side edge from a tip end of the central piece 95*b*. Between the central piece 95*b* and the rear side edge, two ribs 95*d* are formed.

The hook part 97 is formed at a tip end portion of the other side edge (a front side edge, a side edge at the side of the apparatus main body 2). The hook part 97 includes a tapered claw 99 protruding upward along the circumferential direction around the shaft part 91. Between the claw part 99 and the main part 93, a recess 101 recessed inward from the front side edge is formed.

The shaft part 91 is supported by the side plate of the conveying unit 35 in a turnable manner. The hook member 87 is held by a torsion coil spring 98 (a biasing member) in such a posture that the claw 99 protrudes upward and the engagement part 95 extends in an obliquely lower direction from the shaft part 91. By holding the hook member 87 in such a posture, the claw 99 is made to be engaged with the boss 51 of the apparatus main body 2 from the lower side.

Figure 7:
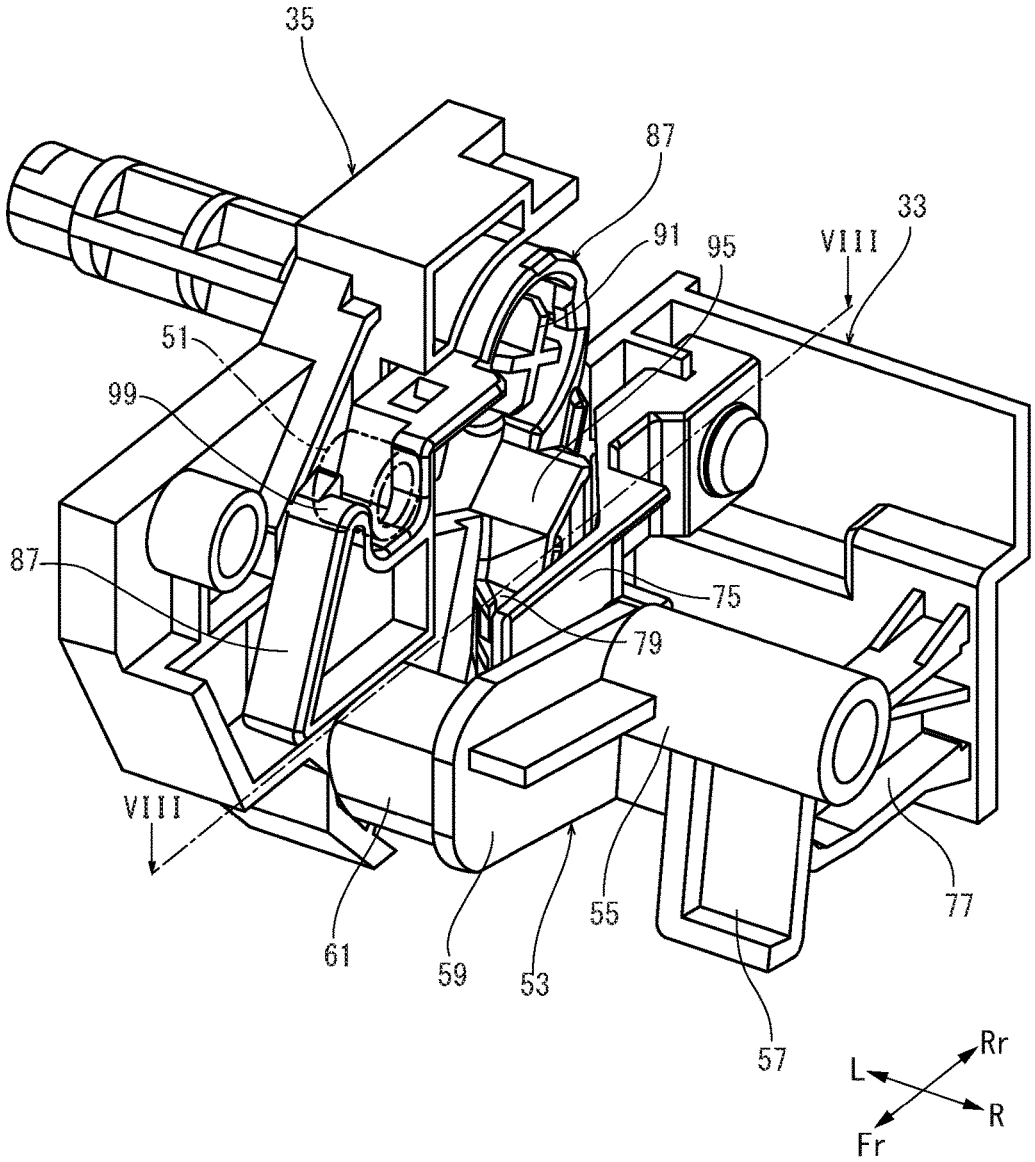
FIG. 7 is a perspective view showing the engaged outer cover and conveying unit when a conveying path is formed, in the color printer according to the embodiment of the present disclosure.
Figure 8A:
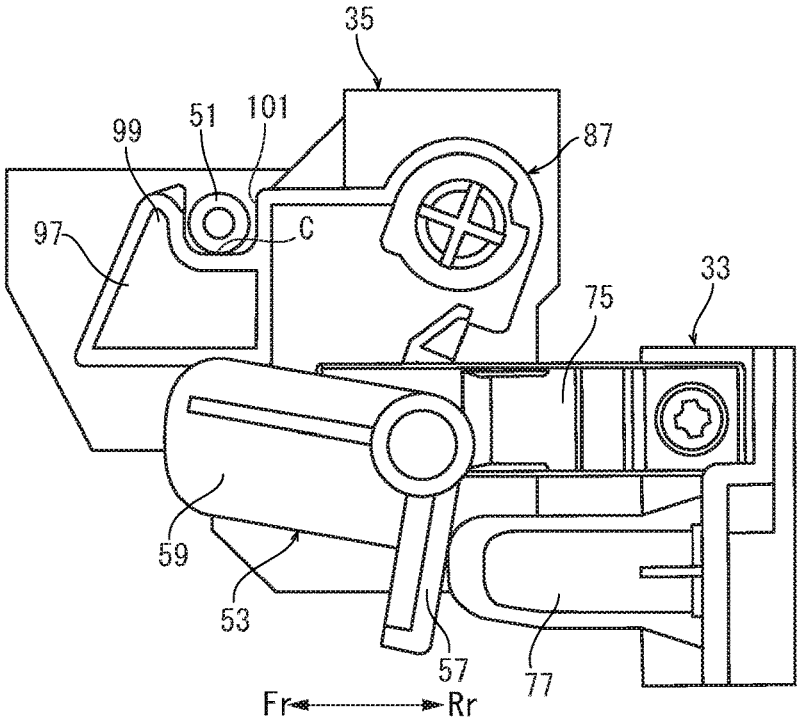
FIG. 8A is a side view showing the engaged outer cover and conveying unit when the conveying path is formed, in the color printer according to the embodiment of the present disclosure.
Figure 8B:
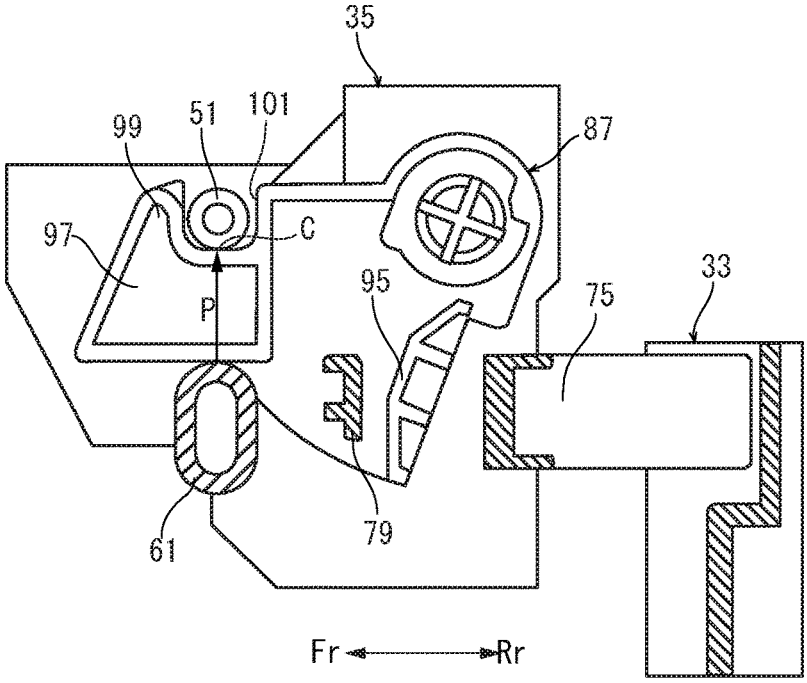
FIG. 8B is a sectional view along a line VIII-VIII in FIG. 7 when the conveying path is formed.

In the color printer 1 having the above described configuration, the cover unit 31 turned upward will be described with reference to FIG. 7, FIG. 8*a* and FIG. 8B. FIG. 7 is a perspective view showing the auxiliary pressing member, the hook part, the pressing part and the hook member, FIG. 8A is a side view showing the auxiliary pressing member, the hook part, the pressing part and the hook member and FIG. 8B is a sectional view along a line VIII-VIII of FIG. 7.

The hook part 75 of the outer cover 33 is coupled to the hook member 87 of the conveying unit 35. In detail, the claw 99 of the hook part 75 is overlapped with the engagement part 95 of the hook member 87 in the front-and-rear direction. As shown in FIG. 8B, the claw 79 is slightly separated from the engagement part 95 forward.

The conveying unit 35 is inserted into the opening 2*b* of the rear side plate 2*a*. Each hook member 87 of the conveying unit 35 is biased by the torsion coil spring 98 such that the claw 99 is engaged with the boss 51 of the apparatus main body 2 from the lower side. In detail, a bottom face of the recess 101 of the hook member 87 comes into contact with the outer circumferential face of the boss 51.

Between the front face plate of the conveying unit 35 and the apparatus main body 2, the conveying path 37 is formed. The secondary transferring roller 21 comes into contact with the intermediate transferring belt 15 with a suitable pressure to form the transfer nip N1. The one resist roller 39*a* comes into contact with the other resist roller 39*b* with a suitable pressure to form the resist nip N2.

The outer cover 33 is engaged with the engagement part of the apparatus main body 2. The guide part 73 is inserted into the opening 2*b*. Between the rear side plate of the conveying unit 35 and the guide part 73, the inversion path 41 is formed. The one rollers 43*a* and 45*a* come into contact with the other rollers 43*b* and 45*b*. The cover plate 71 comes into contact with the rear side plate 2*a* to close the opening 2*b*.

Each push part 77 of the outer cover 33 is passed through the opening 2*e* (refer to FIG. 4A and FIG. 4B) of the rear side plate 2*a* of the apparatus main body 2, and comes into contact with the first arm 57 of the auxiliary pressing member 53 to push the first arm 57 forward. Thereby, the auxiliary pressing member 53 is turned in the clockwise direction in FIG. 8A and FIG. 8B around the turning shaft 55, and the pressing part 61 of the second arm 59 presses the hook part 97 of the hook member 87 upward. As a result, the hook member 87 is engaged with the boss 51 firmly. In detail, a contact point C between the boss 51 and the hook member 87 (a contact point between the outer circumferential face of the boss 51 and the bottom face of the recess 101 of the hook member 87) is positioned on a direction P in which the auxiliary pressing member 53 presses the hook member 87.

Next, an operation to turn the cover unit 31 downward and to open the conveying par 37, the inversion path 41, the transfer nip N1 and the resist nip N2 will be described with reference to FIGS. 9A, 9B, 10A, 10B, 11A, 11B, 12A, 12B, 13A and 13B. FIGS. 9A to 13A are side views showing the auxiliary pressing member, the hook part, the pressing part and the hook member, and FIGS. 9B to 13B are sectional views along a line VIII-VIII of FIG. 7.

Figure 9A:
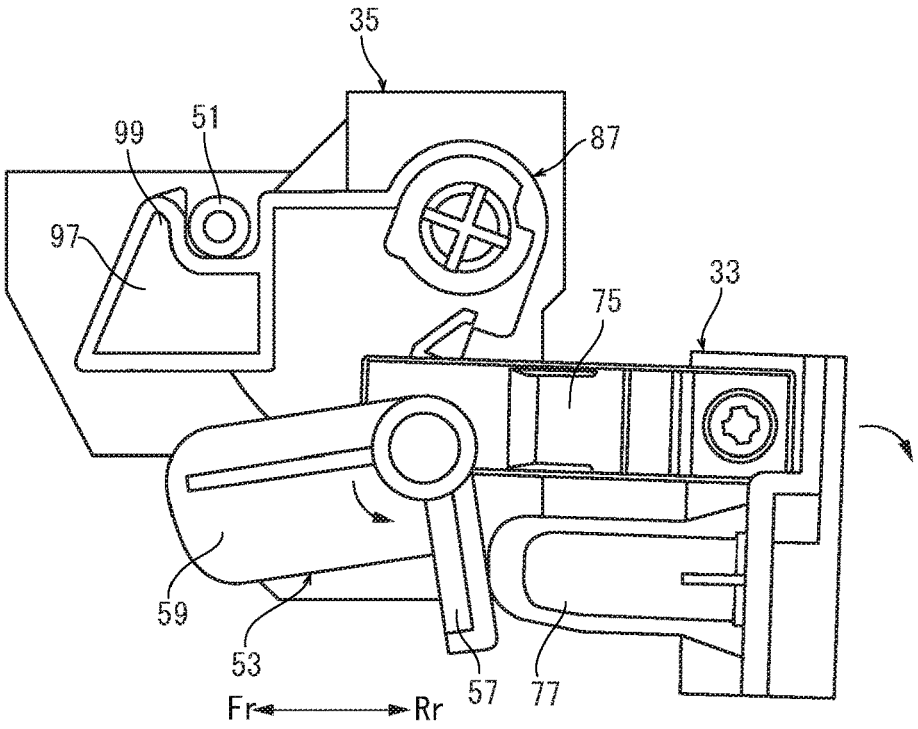
FIG. 9A is a side view showing the engaged outer cover and conveying unit when a pressing of the hook member is released, in the color printer according to the embodiment of the present disclosure.
Figure 9B:
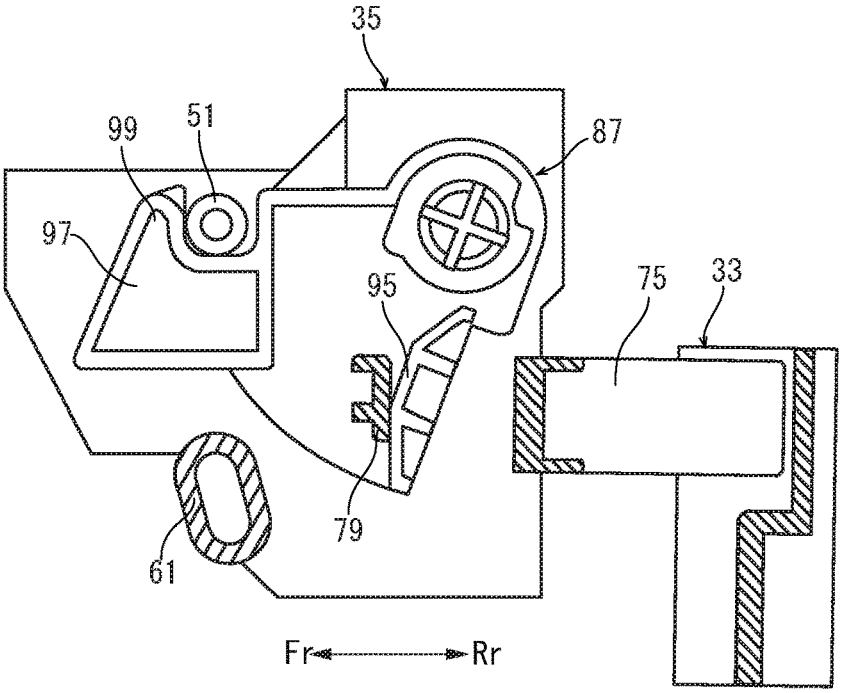
FIG. 9B is a sectional view along the line VIII-VIII in FIG. 7 when the pressing of the hook member is released.

After the engagement of the outer cover 33 with the apparatus main body 2 is released, the outer cover 33 is turned downward by a first angle. Then, the claw 79 of each hook part 75 of the outer cover 33 is displaced rearward, and as shown in FIGS. 9A and 9B, the claw 79 is engaged with the engagement part 95 of the hook member 87. Additionally, the pressing force of the auxiliary pressing member 53 on the first arm 57 is released. Then, the auxiliary pressing member 53 starts to turn in the counterclockwise direction in FIGS. 9A and 9B by the biasing force of the torsion coil spring, and the pressing part 61 of the second arm 59 is separated from the hook part 97 of the hook member 87 downward. Even if the second arm 59 is separated from the hook member 87, the engagement of the hook member 87 with the boss 51 is kept by the biasing force of the torsion coil spring 98. When the outer cover 33 is turned downward with respect to the conveying unit 35 in the above manner, the inversion path 41 between the outer cover 33 and the conveying unit 35 starts to be opened.

Figure 10A:
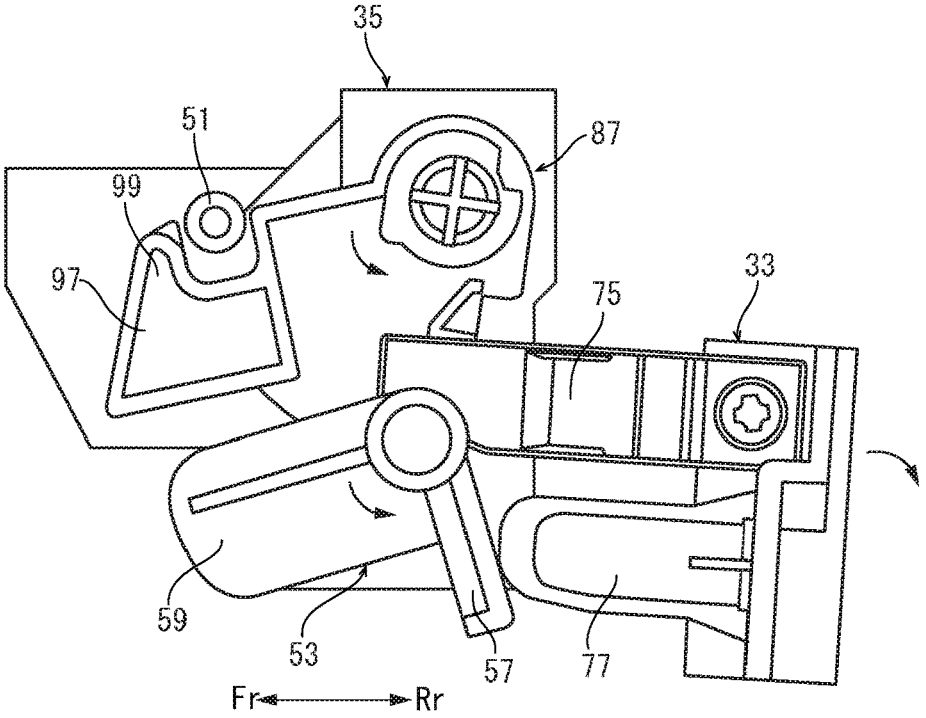
FIG. 10A is a side view showing the engaged outer cover and conveying unit when the hook member starts to turn, in the color printer according to the embodiment of the present disclosure.
Figure 10B:
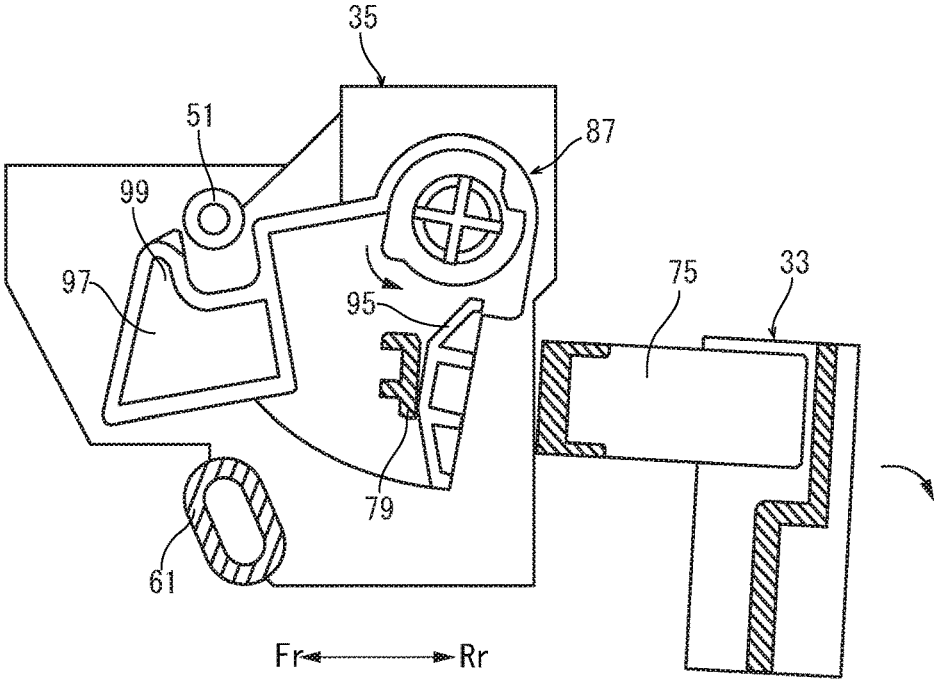
FIG. 10B is a sectional view along the line VIII-VIII in FIG. 7 when the hook member starts to turn.

When the outer cover 33 is further turned downward by a second angle larger than the first angle, as shown in FIGS. 10A and 10B, the engagement part 95 of the hook member 87 is pulled rearward by the claw 79 of the hook part 75, and the hook member 87 starts to turn in the counterclockwise direction in FIGS. 10A and 10B against the biasing force of the torsion coil spring 98. Then, the claw 99 of the hook member 87 starts to be separated from the boss 51 downward. However, because the claw 99 is still engaged with the boss 51, the outer cover 33 is turned with respect to the conveying unit 35 downward to open the inversion path 41 more wider. Additionally, the push part 77 is further separated from the first arm 57 of the auxiliary pressing member 53, and the auxiliary pressing member 53 is further turned in the counterclockwise direction in FIGS. 10A and 10B by the biasing force of the torsion coil spring.

Figure 11A:
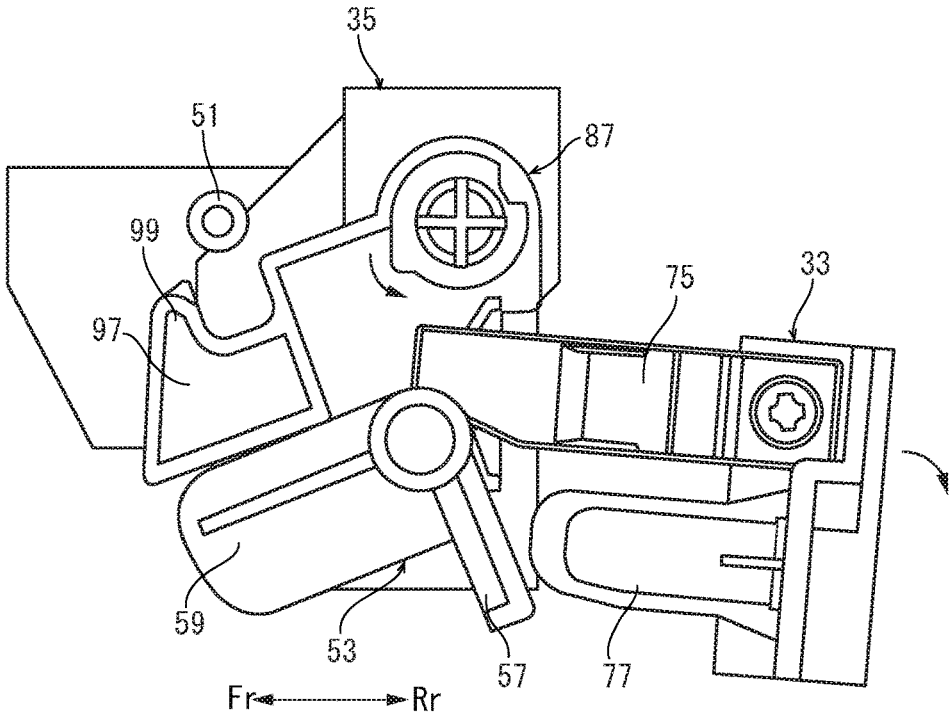
FIG. 11A is a side view showing the engaged outer cover and conveying unit when the hook member is disengaged with the boss, in the color printer according to the embodiment of the present disclosure.
Figure 11B:
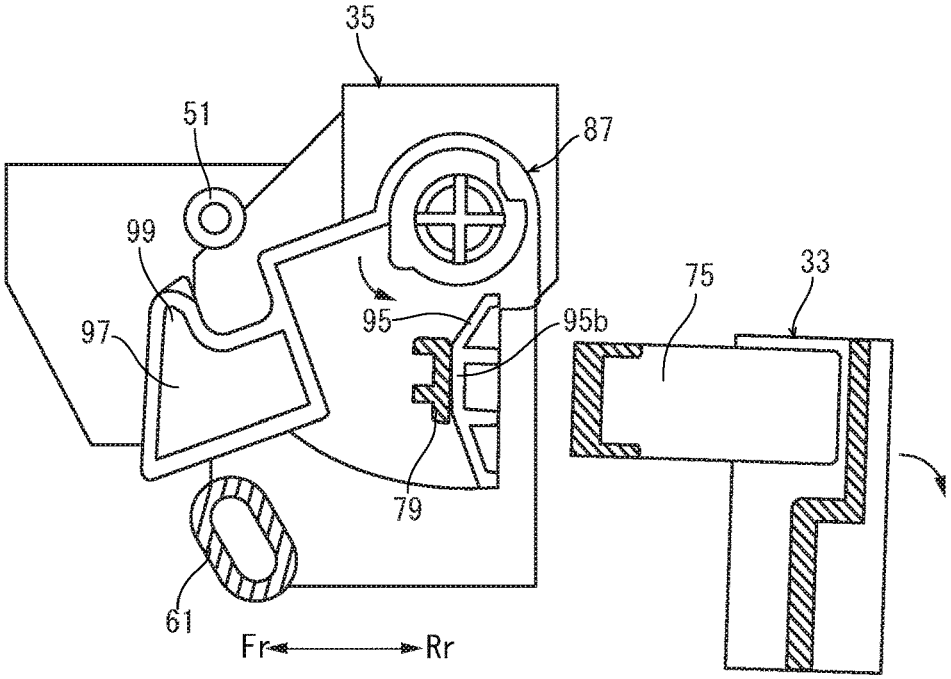
FIG. 11B is a sectional view along the line VIII-VIII in FIG. 7 when the hook member is disengaged with the boss.

When the outer cover 33 is further turned downward, the engagement part 95 of the hook member 87 is further pulled rearward by the claw 79 of the hook part 75. Then, the hook member 87 is further turned in the counterclockwise direction in FIGS. 10A and 10B, and as shown in FIGS. 11A and 11B, the claw 99 is separated from the boss 51 completely to release the engagement of the claw 99 with the boss 51. The hook member 87 is turned until the central piece 95*b* of the engagement part 95 extends substantially vertically, and the claw 99 of the hook part 75 is engaged with the central piece 95*b*. Additionally, the push part 77 is separated from the first arm 57 of the auxiliary pressing member 53 completely.

Figure 12A:
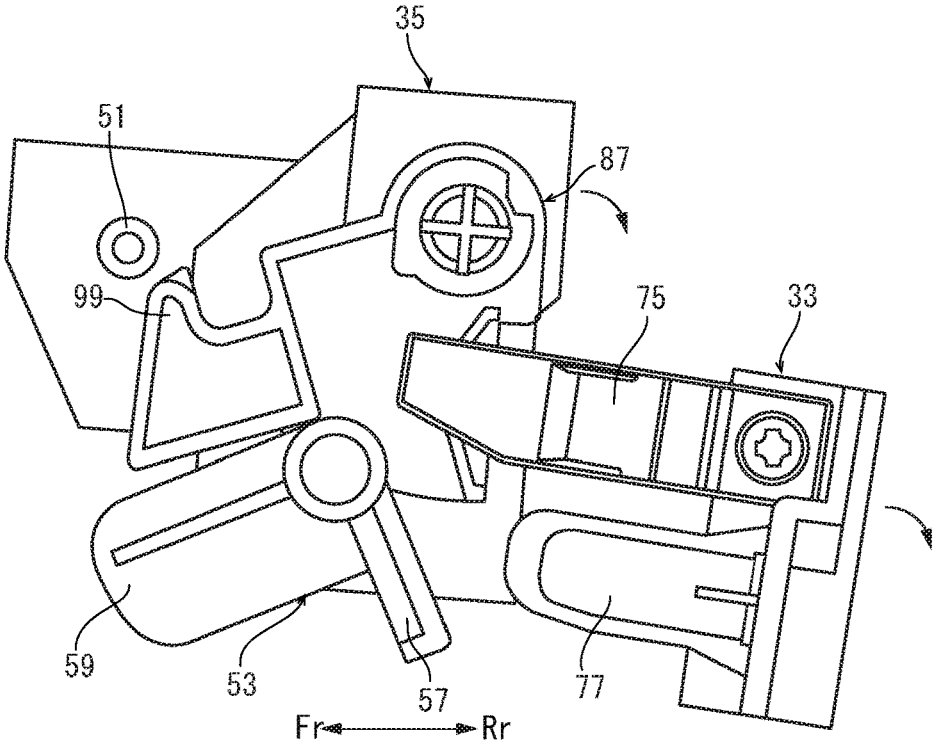
FIG. 12A is a side view showing the engaged outer cover and conveying unit when a turning of the conveying unit is started, in the color printer according to the embodiment of the present disclosure.
Figure 12B:
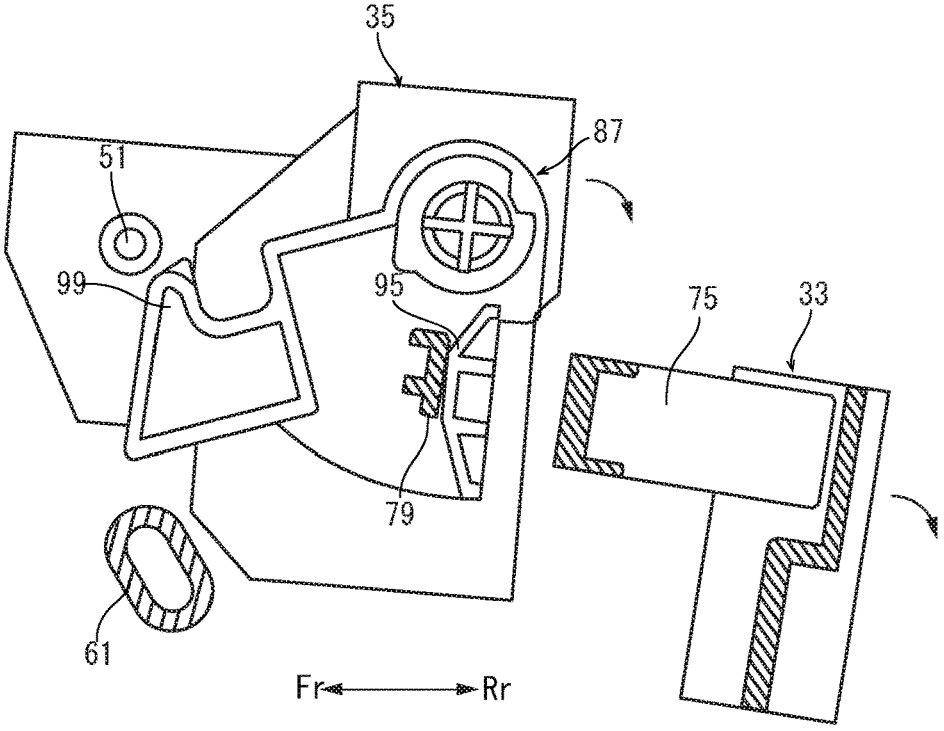
FIG. 12B is a sectional view along the line VIII-VIII in FIG. 7 when the turning of the conveying unit is started.

When the outer cover 33 is further turned downward, as shown in FIGS. 12A and 12B, the engagement part 95 of the hook member 87 is pulled downward by the claw 79 of the hook part 75 of the outer cover 33, and the conveying unit 35 is turned downward with respect to the apparatus main body 2 around the turning shafts 89 together with the outer cover 33. As a result, the conveying path 37, the transfer nip N1 and the resist nip N2 start to be opened.

Figure 13A:
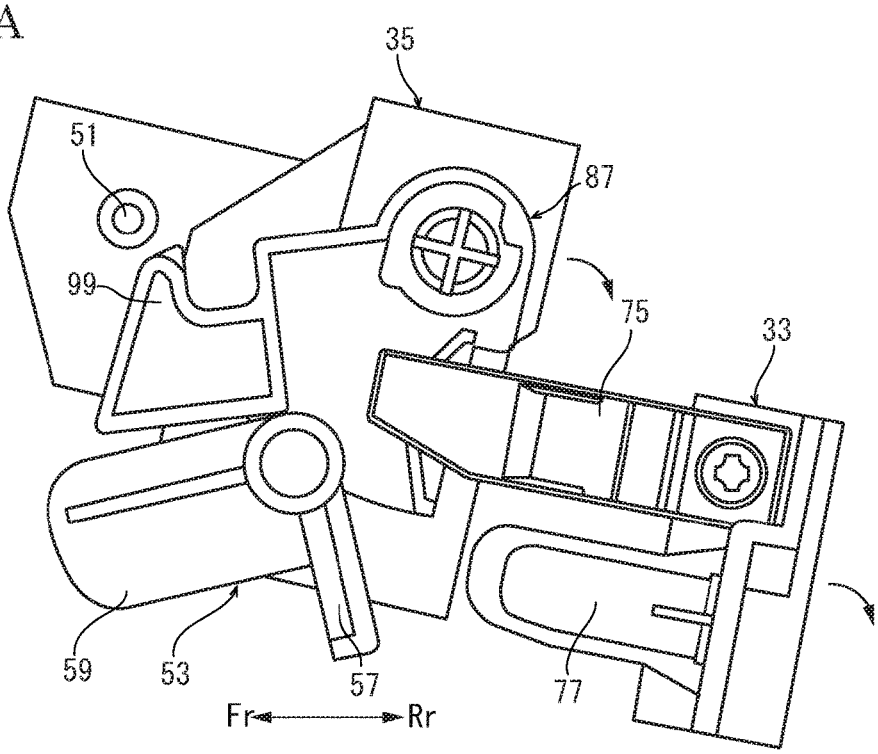
FIG. 13A is a side view showing the engaged outer cover and conveying unit when the turning of the conveying unit is finished, in the color printer according to the embodiment of the present disclosure.
Figure 13B:
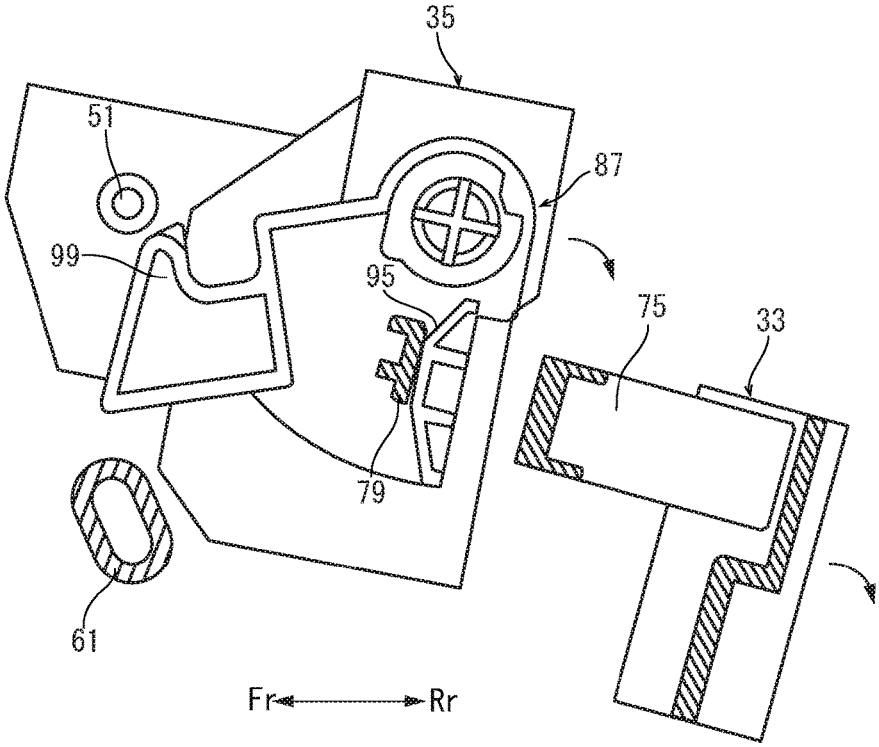
FIG. 13B is a sectional view along a line VIII-VIII in FIG. 7 when the turning of the conveying unit is finished.

The conveying unit 35 is turned downward together with the outer cover 33 until the conveying path 37 is sufficiently opened as shown in FIGS. 13A and 13B.

An operation to turn the outer cover 33 and the conveying unit 35 upward and to form the conveying path 37, the inversion path 41, the transfer nip N1 and the resist nip N2 is carried out in a reverse manner to the above described manner.

That is, as shown in FIGS. 11A and 11B, when the conveying unit 35 is turned upward together with the outer cover 33, the secondary transferring roller 21 and the one resist roller 39*a* respectively come into contact with the intermediate transferring belt 15 and the other resist roller 39*b* to form the transfer nip N1 and the resist nip N2, as shown in FIG. 1. At this time, the secondary transferring roller and the one resist roller 39*a* are moved along the circumferential direction around the turning shaft 89, and respectively come into contact with the intermediate transferring belt 15 and the other resist roller 39*b* from substantially the rear side.

After that, when the outer cover 33 is further turned upward, because the outer cover 33 gets close to the conveying unit 35 relatively, the claw 79 of the hook part 75 is displaced forward from the engagement part 95 of the hook member 87 and separated from the engagement part 95. As a result, as shown in FIGS. 10A and 10B, the hook member 87 starts to turn in the clockwise direction in FIGS. 10A and 10B by the biasing force of the torsion coil spring 98. Additionally, the push part 77 of the outer cover 33 comes into contact with the first arm 57 of the auxiliary pressing member 53.

When the outer cover 33 is further turned upward, the hook member 87 is further turned, and the claw 99 is engaged with the boss 51 as shown in FIGS. 9A and 9B. The first arm 57 of the auxiliary pressing member 53 is pushed by the push part 77 and starts to turn in the clockwise direction in FIGS. 9A and 9B.

When the outer cover 33 is turned until it comes into contact with the apparatus main body 2, the first arm 57 of the auxiliary pressing member 53 is pushed by the push part 77 as shown in FIGS. 8A and 8B, and then the auxiliary pressing member 53 is turned in the clockwise direction in FIGS. 8A and 8B. Then, the pressing part 61 of the second arm 59 presses the hook part 97 of the auxiliary pressing member 53 upward. That is, after the hook member 87 is engaged with the boss 51, the hook part 97 of the hook member 87 is pressed upward by the pressing part 61 of the auxiliary pressing member 53.

When the engagement of the outer cover 33 with the conveying unit 35 is released, the outer cover 33 and the conveying unit 35 are turned so as to separate them from each other. As a result, the claw 79 of the hook part 75 of the outer cover 33 is relatively released from the engagement part 95 of the hook member 87 of the conveying unit 35. That is, as described above, because the supporting shaft 2*f* of the outer cover 33 is arranged below the turning shaft 89 of the conveying unit 35, a distance between the claw 79 and the supporting shaft 2*f* is larger than a distance between the engagement part 95 and the turning shaft 89. Therefore, a turning radius of the claw 79 is larger than a turning radius of the engagement part 95 so that the claw 79 is separated from the engagement part 95 upward during the turning of the outer cover 33, and then the engagement of the engagement part 95 with the claw 99 is released.

As described above, according to the color printer 1 of the present disclosure, after the hook member 87 of the conveying unit 35 is engaged with the boss 51 of the apparatus main body 2, the auxiliary pressing member 53 presses the hook member 87 in a direction in which the hook member 87 is engaged with the boss 51. At this time, a direction in which the auxiliary pressing member 53 presses the hook member 87 is different from the turning direction of the conveying unit 35. The direction in which the auxiliary pressing member 53 presses the hook member 87 is the upper direction. On the other hand, the conveying unit 35 is turned upward and downward along the circumferential direction around the turning shaft 89. If the direction in which the auxiliary pressing member 53 presses the hook member 87 is the same as the turning direction of the conveying unit 35, the transfer nip N1 pressure and the resist nip N2 pressure may be affected to cause a sheet conveying failure or the like. In the present disclosure, the directions are different from each other so that it becomes possible to engage the hook member 87 with the boss 51 firmly without affecting the transfer nip N1 pressure and the resist nip N2 pressure.

Additionally, the contact point between the boss 51 and the hook member 87 (the contact point C between the outer circumferential face of the boss 51 and the bottom face of the recess 101 of the hook member 87) is positioned on the direction P in which the auxiliary pressing member 53 presses the hook member 87. This makes it possible to transmit the pressing force of the auxiliary pressing member 53 to the hook member 87 effectively so that the engagement force of the hook member 87 with the boss 51 can be enhanced. Additionally, the direction P in which the auxiliary pressing member 53 presses the hook member 87 is substantially perpendicular to the turning direction of the conveying unit 35 when the transfer nip N1 and the resist nip N are formed. Therefore, a pressing load applied to the apparatus main body 2 from the conveying unit 2 is hardly affected. However, the direction in which the auxiliary pressing member 53 presses the hook member 87 is not always the upper direction.

Additionally, in a state where the cover unit 31 is turned upward and the hook member 87 is engaged with the boss 51, as shown in FIGS. 9A and 9B, the auxiliary pressing member 53 does not press the hook member 87. That is, a force to engage the hook member 87 with the boss 51 is the biasing force of the torsion coil spring 98, and after the hook member 87 is engaged with the boss 51, the auxiliary pressing member 53 presses the hook member 87. Accordingly, in order to engage the hook member 87 with the boss 51 firmly, it is not required to strengthen spring force of the torsion coil spring 98. If the torsion coil spring 98 has a large spring force, large force is required to disengage the hook member 87 with the boss 51 and workability for turning the conveying unit 35 is deteriorated. However, in the present disclosure, the torsion coil spring 98 does not require the strong spring force so that it becomes possible to turn the conveying unit 35 smoothly.

Additionally, because the turning of the outer cover 33 makes it possible to make the auxiliary pressing member 53 automatically press the hook member 87 in a direction in which the hook member 87 is engaged with the boss 51, the workability can be more improved.

Additionally, by adjusting the length of the first arm 57 and the second arm 59 of the auxiliary pressing member 53, it becomes possible to adjust a turning strake of the outer cover 33 and a pressing amount of the hook member 87 suitably.

In the present embodiment, the auxiliary pressing member 53 is pushed by the outer cover 4 to be turned and to press the hook member 87 so as to be engaged with the boss 51. However, the auxiliary pressing member 53 may be turned by a mechanism provided on the conveying unit 35 or the apparatus main body 2 to press the hook member 87 so as to be engaged with the boss 51.

In the present embodiment, the auxiliary pressing member 53 is turned to press the hook member 87 so as to be engaged with the boss 51. However, the auxiliary pressing member 53 may be slid to press the hook member 87 so as to be engaged with the boss 51.

While the above description has been described with reference to the particular illustrative embodiments of the image forming apparatus according to the present disclosure, a technical range of the disclosure is not to be restricted by the description and illustration of the embodiment.

The invention claimed is:

1. An image forming apparatus comprising:

a conveying unit provided at an apparatus main body in a turnable manner and configured to form or open a nip area between the conveying unit and the apparatus main body, a sheet being conveyed through the nip area;

a boss provided at the apparatus main body;

a hook member provided at the conveying unit in a turnable manner and configured to be engaged with the boss when the conveying unit is turned to a position where the nip area is formed; and an auxiliary pressing member configured to press the hook member in a direction in which the hook member is engaged with the boss after the hook member is engaged with the boss, wherein a direction in which the auxiliary pressing member presses the hook member is different from a turning direction of the conveying unit.

2. The image forming apparatus according to claim 1, wherein the auxiliary pressing member presses the hook member upward, and the conveying unit is turned upward and downward along a circumferential direction around a turning shaft provided at a lower portion of the conveying unit.

3. The image forming apparatus according to claim 1, further comprising an outer cover provided outside the conveying unit in a turnable manner and configured to form or open a sheet inversion path between the outer cover and the apparatus main body, wherein the outer cover includes a push part configured to push the auxiliary pressing member when the outer cover is turned to a position where the inversion path is formed, and the auxiliary pressing member is pushed by the push part to press the hook member in the direction in which the hook member is engaged with the boss.

4. The image forming apparatus according to claim 3, wherein the auxiliary pressing member includes:

a turning shaft supported by the apparatus main body in a rotatable manner;

a first arm extending in a radial direction from the rotation shaft and configured to face the push part when the outer cover is turned to the position where the inversion path is formed; and a second arm extending in a radial direction from the rotation shaft and configured to face the hook member, when the outer cover is turned to the position where the inversion path is formed, the first arm is pushed by the push part to rotate the rotation shaft and then the second arm presses the hook member in the direction in which the hook member is engaged with the boss.

5. The image forming apparatus according to claim 1, wherein when the conveying unit is turned to the position where the nip area is formed, the hook member and the boss are engaged with each other at one or more contact positions, and one of the contact positions is positioned on the direction in which the auxiliary pressing member presses the hook member.

6. The image forming apparatus according to claim 3, comprising:

a biasing member configured to bias the hook member in the direction in which the hook member is engaged with the boss; and a hook part provided at the outer cover so as to be engaged with an engagement part provided at the hook member, wherein in a state where the outer cover is turned to the position where the inversion path is formed, the engagement part is separated from the hook part, when the outer cover is turned by a first angle in a direction in which the inversion path is opened, the engagement part is engaged with the hook part, and when the outer cover is turned by a second angle larger than the first angle in the direction in which the inversion path is opened, the hook part rotates the hook member against biasing force of the biasing member in an opposite direction to the direction in which the hook member is engaged with the boss.

7. The image forming apparatus according to claim 6, wherein when the outer cover is turned by the first angle in the direction in which the inversion path is opened, the push part is separated from the hook member.

* * * * *